US006712448B2

(12) United States Patent
Tsurui

(10) Patent No.: US 6,712,448 B2
(45) Date of Patent: Mar. 30, 2004

(54) IMAGE FORMING APPARATUS

(75) Inventor: Norio Tsurui, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 10/101,970

(22) Filed: Mar. 21, 2002

(65) Prior Publication Data

US 2002/0140761 A1 Oct. 3, 2002

(30) Foreign Application Priority Data

Mar. 29, 2001 (JP) ..... 2001/095547
Mar. 14, 2002 (JP) ..... 2002/070357

(51) Int. Cl.[7] ..... B41J 2/165
(52) U.S. Cl. ..... 347/34
(58) Field of Search ..... 347/22, 18, 24, 347/31, 34, 83, 93

(56) References Cited

U.S. PATENT DOCUMENTS 5,296,873 A * 3/1994 Russell et al. ..... 346/25
6,464,328 B1 * 10/2002 Hiramatsu et al. ..... 347/34

* cited by examiner

*Primary Examiner*—Shih-Wen Hsieh
(74) *Attorney, Agent, or Firm*—Fitzpatrick, Cella, Harper & Scinto

(57) ABSTRACT

An image forming apparatus for forming an image in a predetermined image forming region by discharging ink droplets includes an image forming unit for forming an image in the predetermined image forming region, and a suction unit for sucking air including ink mist generated when forming the image by the image forming unit. The suction unit includes at least one suction port provided near the image forming region, and an exhaust path formed below said suction port. The exhaust path includes a slope inclined in a direction crossing a direction of flow of the air including the ink mist sucked into the exhaust path, and an ink collecting portion provided on the slope. According to this configuration, the apparatus collects ink mist generated during recording.

32 Claims, 4 Drawing Sheets

IMAGE FORMING APPARATUS

BACKGROUND OF THE INVENTION

1. Field of the Invention

The present invention relates to an ink-jet-type image forming apparatus which records an image by discharging ink droplets onto a recording medium.

2. Description of the Related Art

Typical ink-jet recorders of this type are serial-type ink-jet recorders and line-type ink-jet recorders. In serial-type ink-jet recorders, a recording head is mounted on a carriage reciprocated in a direction perpendicular to the conveying direction of a recording medium, and an image is formed on the recording medium by alternately repeating conveyance of the recording material with a predetermined pitch and reciprocating movement of the carriage. In line-type ink-jet recorders, a recording head whose length is substantially equal to the width of a recording material is used, and an image is formed on the recording material together with conveyance of the recording material.

However, in the above-described conventional techniques, when discharging ink droplets from the recording head, ink mist comprising very small ink droplets which do not contribute to image recording is generated in addition to ink droplets which contribute to image recording. This ink mist flies around the recording head, and adheres to and is accumulated on components present within the range of the flying the ink mist, thereby causing problems. For example, if a platen facing the recording head via a recording medium is stained with the ink mist, ink stain adheres to the back of the recording material. Furthermore, if the viscosity of ink on the platen increases, sliding between the recording medium and the platen is degraded, thereby causing a failure in conveyance of the recording medium, such as a sheet jam, skew, a crease, undulation or the like. In the case of serial-type ink-jet recorders, there is the possibility that ink mist adheres to a guide member of the carriage, thereby causing a failure in operation due to an increase of resistance against scanning. When performing control of the position of the carriage using a signal from an optical encoder disposed in a main scanning direction, accuracy in detection is degraded by adherence of ink mist to the encoder, thereby causing degradation in accuracy of recording, a failure in position control, or the like.

SUMMARY OF THE INVENTION

The present invention has been made in consideration of the above-described problems.

It is an object of the present invention to provide an image forming apparatus which can always perform a stable image recording operation by collecting ink mist while preventing an increase in the size of the apparatus and complexity of the apparatus, and degradation in the reliability of the apparatus.

It is another object of the present invention to provide an image forming apparatus which includes a member capable of maintaining a constant ink-mist collecting capability in an ink-mist discharging path.

According to one aspect of the present invention, an image forming apparatus for forming an image in a predetermined image forming region by discharging ink droplets includes an image forming unit for forming an image in the predetermined image forming region, and a suction unit for sucking air including ink mist generated when forming the image by the image forming unit. The suction unit includes at least one suction port provided near the image forming region, and an exhaust path formed below the suction port. The exhaust path includes a slope inclined in a direction crossing a direction of flow of the air including the ink mist sucked into the exhaust path, and an ink collecting portion provided on the slope.

The foregoing and other objects, advantages and features of the present invention will become more apparent from the following detailed description of the preferred embodiment taken in conjunction with the accompanying drawings.

DETAILED DESCRIPTION OF THE PREFERRED EMBODIMENT

A preferred embodiment of the present invention will now be described with reference to the drawings.

Figure 1:
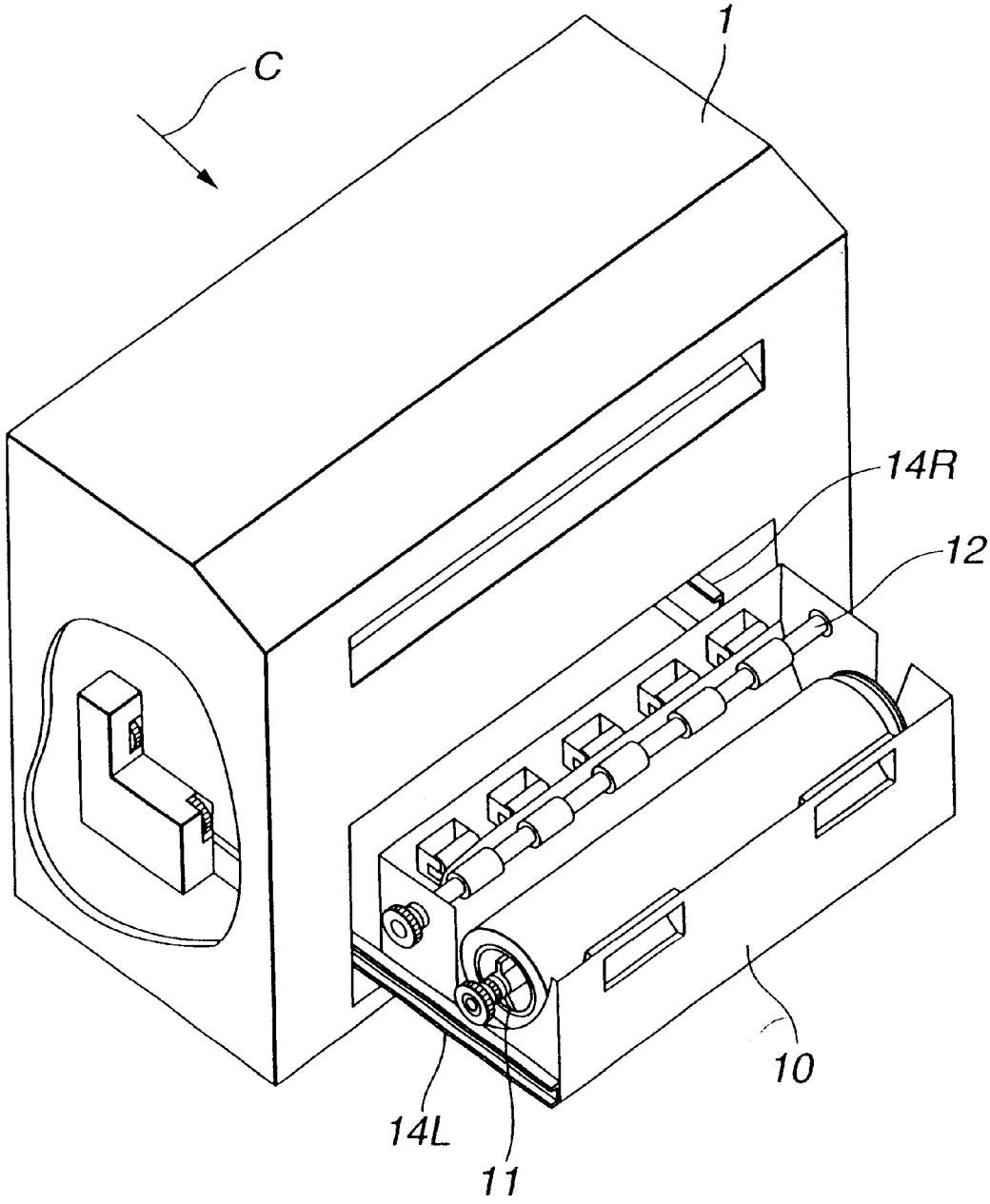
FIG. 1 is a perspective view illustrating an external appearance of an image forming apparatus according to an embodiment of the present invention.
Figure 2:
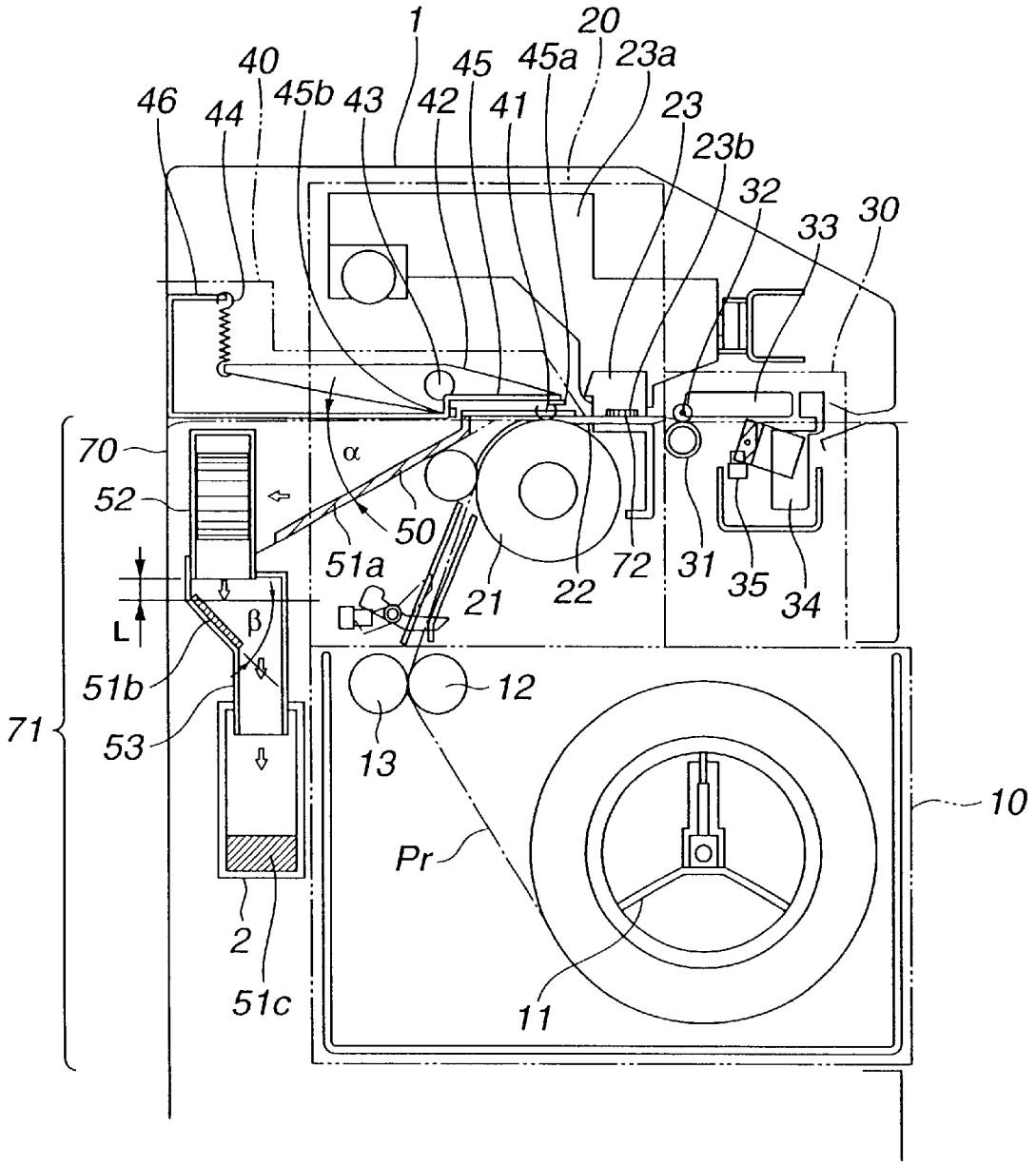
FIG. 2 is a side cross-sectional view of the image forming apparatus shown in FIG. 1.
Figure 3:
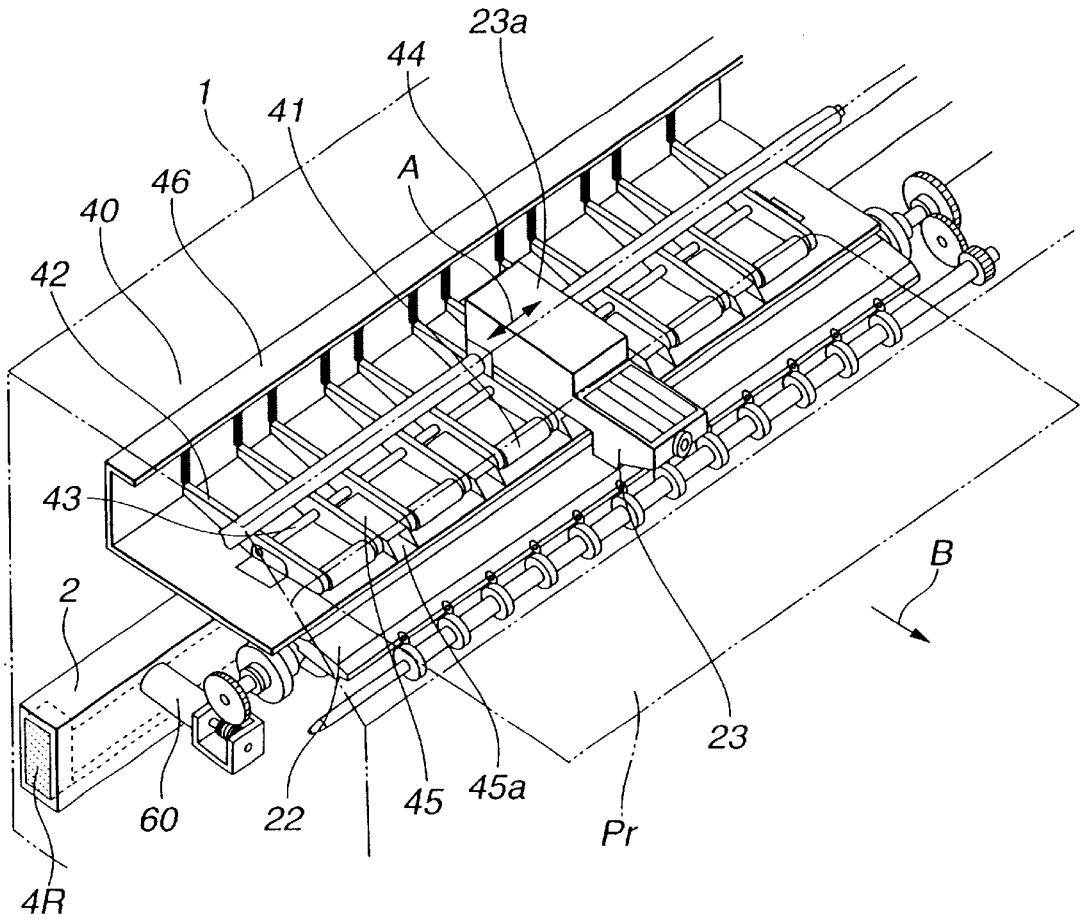
FIG. 3 is a see-through perspective view illustrating the configuration of an image forming unit of the image forming apparatus shown in FIG. 1.

FIG. 1 is a perspective view illustrating an external appearance of an image forming apparatus according to the preferred embodiment. FIG. 2 is a side cross-sectional view of the image forming apparatus shown in FIG. 1. FIG. 3 is a see-through perspective view illustrating the configuration of an image forming unit of the image forming apparatus shown in FIG. 1.

The image forming apparatus of the embodiment includes a recording-material holder 10 for rotatably holding and feeding a recording material Pr in the form of a roll, an image forming unit 20 for performing image formation while holding the recording material Pr fed from the recording-material holder 10, a sheet discharging unit 30 for discharging the recording material Pr after image formation to the outside of the apparatus, and an ink-mist suction unit 70 for sucking ink mist generated when discharging ink droplets form a recording head 23.

The recording-material holder 10 includes a spool 11 for rotatably holding the recording material Pr, a roll feeding roller 12 for feeding and conveying the recording material Pr, and a plurality of roll driven rollers 13. In order to facilitate an operation of exchanging the recording material Pr, the recording-material holder 10 is supported by slide rails 14L and 14R so as to be able to be drawn from an apparatus main body 1. Driving of the roll feeding roller 12 is performed by transmitting driving of a sub-scanning motor 60 (to be described later).

The image forming unit 20 includes a sub-scanning roller 21 (conveyance of the recording material Pr during recording in the image forming apparatus of the embodiment is called sub-scanning) for conveying the recording material Pr by a predetermined amount during image formation, a press unit 40 (to be described later), a platen 22 for holding the recording material Pr in the form of a plane, and a carriage 23*a* for reciprocating the recording head 23 at a position facing the platen 22.

The recording head 23 includes a device substrate on which a plurality of discharging-energy generation devices, such as electrothermal transducers or the like, a plurality of very small discharging ports 23*b*, and a plurality of liquid channels communicating with corresponding ones of the very small discharging ports 23*b*, and is manufactured so that the discharging-energy generation devices and the corresponding liquid channels are exactly aligned. By supplying each of the discharging-energy generation devices with electric energy, a change in the state, i.e., an abrupt change in the volume (to cause generation of a bubble), of ink supplied from the outside which is connected to the discharging-energy generation device is produced. An ink droplet is discharged from the corresponding discharging port 23*b* by an operating force based on the change of the state of ink, and image formation is performed by causing the discharged ink droplet to adhere to the recording material Pr.

The recording head 23 is mounted on the carriage 23*a* and is caused to perform reciprocating scanning in the directions of a two-headed arrow A which are substantially orthogonal to the recording-material conveying direction B (this scanning is called main scanning). An image is formed by discharging ink droplets from the discharging ports 23*b* toward the recording material Pr in response to a head driving signal based on image data generated in accordance with the period of the main scanning. The recording material Pr is conveyed by a predetermined amount by the sub-scanning roller 21 at every scanning period of the recording head 23. Since accuracy in the conveyance at that time greatly relates to the image quality, the outer diameter, deflection and the like of the sub-scanning roller 21 are very precisely processed. In addition, by increasing the coefficient of friction of the surface of the sub-scanning roller 21 according to sandblast processing or the like, slip of the recording material Pr is prevented as much as possible. The sub-scanning roller 21 is driven by a sub-scanning motor 60. The sub-scanning motor 60 also transmits driving to a sheet discharging roller 31 (to be described later) and the roll feeding roller 12.

The sheet discharging unit 30 includes a sheet discharging roller 31, a plurality of spurs 32 rotatably driven by the sheet discharging roller 31, a spur stay 33 for holding the spurs 32, a cutter 34 for cutting the recording material Pr to a predetermined length, and a discharged-sheet sensor 35. The conveying speed of the recording material Pr by the sheet discharging roller 31 is set to be a few % higher than the conveying speed by the sub-scanning roller 21, so that the recording material Pr does not loosen on the platen 22. By setting the conveying force of the sheet discharging roller 31 to a value smaller than the conveying force of the sub-scanning roller 21, the recording material Pr is caused to always slip on the sheet discharging roller 31.

Next, the press unit 40 will be described.

The press unit 40 includes a plurality of press rollers 41 rotatably driven by the sub-scanning roller 21, and pressing arms 42, provided at both sides of each of the press rollers 41, for rotatably supporting the press rollers 41.

The pressing arms 42 are rotatable around a supporting shaft 43, and provide the press rollers 41 with a predetermined pressing force by pressing springs 44 provided at rear portions of the pressing arms 42.

A plurality of suction nozzles 45 and suction ports 45*a*, serving as openings of the suction nozzles 45, are disposed between respective adjacent press rollers 41 in the vicinity of an image forming region 72. The supporting shaft 43 and the suction nozzles 45 are mounted on a press stay 46. The image forming region 72 indicates a region where the recording head 23 forms an image on the recording material Pr by discharging ink droplets from the discharging ports 23*b* while performing scanning in the scanning directions A by being moved by the carriage 23*a*, i.e., a region where the amount of fly of ink mist is large.

Figure 4:
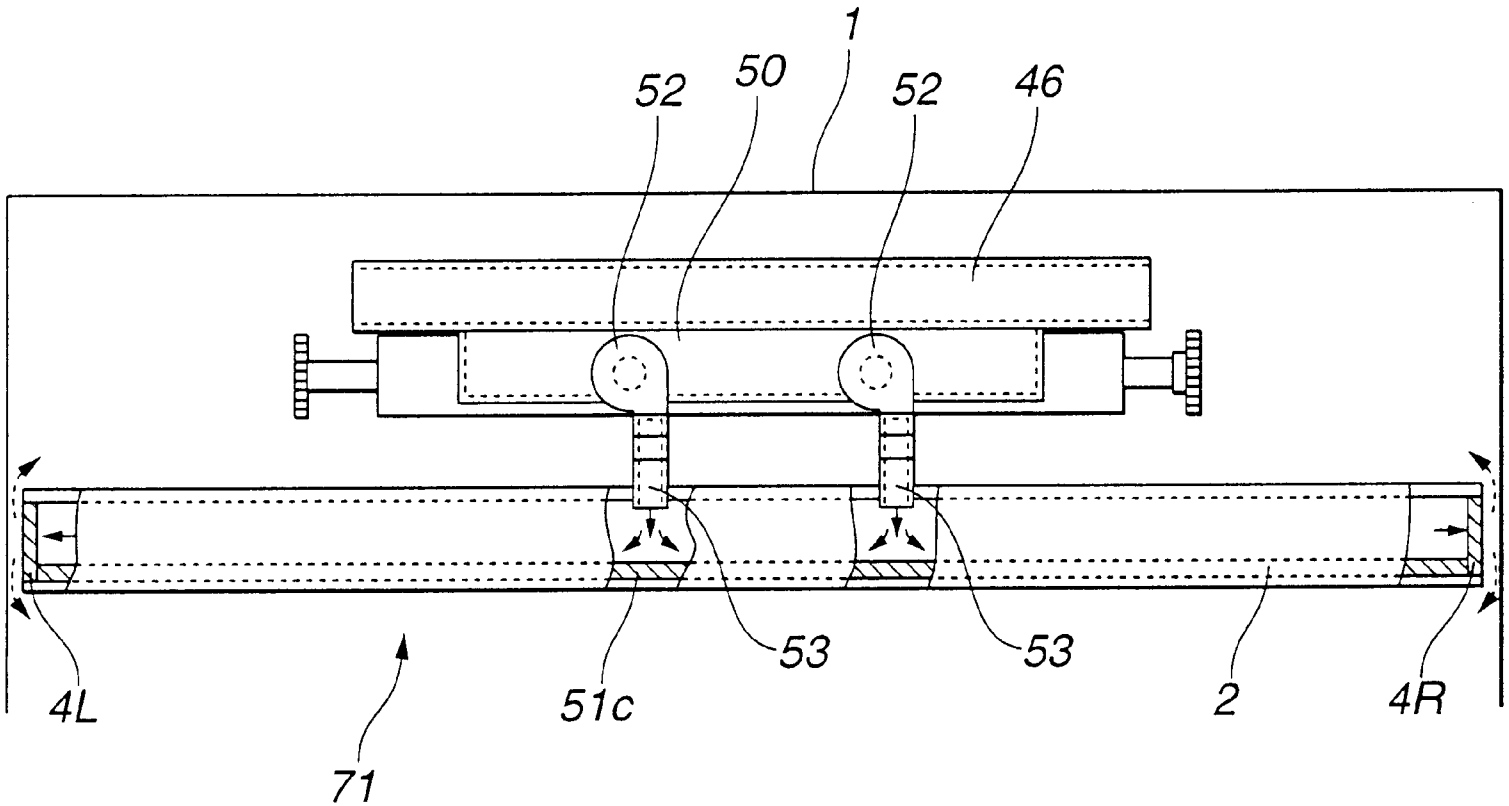
FIG. 4 is a see-through back view of the image forming apparatus shown in FIG. 1, as seen from the direction of an arrow C shown in FIG. 1.

Next, the configuration of the ink-mist suction unit 70 will be described also with reference to the see-through back view of the image forming apparatus shown in FIG. 4, in which the image forming apparatus is seen from the direction of an arrow C shown in FIG. 1.

The ink-mist suction unit 70 includes suction nozzles 45, suction ports 45*a* of the suction nozzles 45, and an exhaust unit 71 provided at a portion lower than the suction ports 45*a* of the suction nozzles 45.

The suction nozzles 45 are disposed between respective adjacent press rollers 41 in a space lower than the carriage 23*a* at portions upstream from the image forming region 72, where an image is formed on the recording material Pr by the recording head 23, in the recording-material conveying direction. The suction ports 45*a* of the suction nozzles 45 are open in a direction downstream from the image forming region 72, where an image is formed on the recording material Pr by the recording head 23, in the recording-material conveying direction. Accordingly, as described above, since the suction ports 45*a* are positioned near the image forming region 72, it can suck ink mist generated when ink droplets are discharged from the recording head 23, before the ink mist diffuses within the apparatus. By disposing the suction ports 45*a* at portions upstream from the image forming region 72 in order to perform a suction operation, the flow of air containing ink mist is generated toward a central portion of the image forming apparatus. That is, by generating an air flow in a direction opposite to the direction of discharge of the recording material Pr, it is possible to prevent air containing ink mist from being discharged to the outside of the apparatus.

Exhaust ports 45*b* of the suction nozzles 45 are formed so that the openings of the exhaust ports 45*b* are present at portions lower than the platen 22, and communicate with a suction duct 50 of the exhaust unit 71.

The exhaust unit 71 includes the suction duct 50 whose lower surface is inclined, a suction fan 52, a main-body stay 2, and an exhaust joint 53 connecting the suction fan 52 to the main-body stay 2. These units are connected so as to be airtight with respect to the outside of the apparatus. The main-body stay 2 is a member for increasing the rigidity of the image forming apparatus, and also operates as an exhaust duct with a hollow structure. The exhaust unit 71 sucks air containing ink mist from the suction nozzles 45 by rotation of the suction fan 52, and exhausts the sucked air toward the main-body stay 2.

The suction duct 50 is disposed in parallel to the main scanning direction A below the lower surface of the press stay 46. The lower surface of the suction duct 50 is inclined in a direction crossing the flow of the incoming air containing the ink mist. The angle of inclination a of the lower surface of the suction duct 50 of the embodiment is within a range between about 25 degrees and 35 degrees downward from the horizontal line. The size of the slope of the suction duct 50 is 117 cm wide (in the main scanning direction) and 4 cm long. A first absorber 51*a* is bonded on the entire lower surface of the slope of the suction duct 50. By projecting sucked air onto the first absorber 51*a*, the ink mist contained in the air exhausted from the exhaust port 45*b* of the suction nozzles 45 can be filtered.

A porous material which can have a high cleaning capability by receiving dust and ink mist within pores is mostly used for the first absorber 51*a*. For example, a polymeric porous material obtained by sintering polymeric polyethylene, high-density polyethylene or low-density polyethylene, or a polymeric foam material of polyurethane may be used as the porous material. The size of the absorber used in this embodiment is 117 cm wide, 5 cm long, and 6 mm thick.

Two suction fans 52 are mounted at the back of the suction duct 50. In order to obtain a high suction efficiency, a sirocco fan having a high static pressure which incorporates a DC motor is used as the fan used in this apparatus. Any appropriate fan other than the sirocco fan, such as an axial fan or the like, may also be used in consideration of a lower cost and space saving. On-off control of the suction fans 52 is linked with a power switch of the main body of the image forming apparatus.

At a portion immediately below the fan exhaust port of an exhaust joint 53 provided at a portion near the exhaust ports of the suction fans 52, a slope inclined in a direction crossing the flow of the incoming air containing the ink mist is also formed, as in the suction duct 50. The cross section of an air channel of the exhaust joint 53 is 15 square centimeters. The area of the slope is also 15 square centimeters. A second absorber 51*b* for absorbing ink mist which could not be absorbed by the first absorber 51*a* is also bonded on this slope. The material for the second absorber 51*b* is the same as the material for the first absorber 51*a*. The size of the second absorber 51*b* is 15 square centimeters and 6 mm thick. By disposing this slope near the exhaust ports of the suction fans 52 substantially horizontally, a resistance against the flow of air is provided, so that the efficiency of collecting ink mist by the second absorber 51*b* is improved. However, if the resistance is two large, the flow of air is degraded, thereby providing an adverse effect. Accordingly, in this embodiment, a point to start inclination of the slope of the exhaust joint 53 is set to 4 mm from the exhaust ports of the suction fans 52, and the angle of inclination β is set to at least 40 degrees and equal to or less than 50 degrees downward from the horizontal line.

The above-described ink collecting portion (ink absorber) provided on each of the slopes removes ink mist from air by temporarily holding the ink mist by providing a resistance against the air flow. The ink mist temporarily held in the ink collecting portion is discharged downward along the slope if the amount of the ink mist exceeds an amount which can be temporarily held by the ink absorbing/holding unit. As a result, the capability of temporarily holding ink mist can be recovered. Accordingly, the capability of temporarily holding ink mist can be maintained irrespective of the operation of the apparatus or the suction fans 52. Any appropriate member other than the ink absorber can be used on the surface of the slope, provided that ink mist can be temporarily held. However, the ink absorber is the best selection because a large amount of ink mist can be temporarily held and a low cost can be realized.

The exhaust joint 53 is connected to the inside of the main-body stay 2 having a rectangular cross section disposed in parallel to the main scanning direction.

Since the main-body stay 2 is a member for increasing the rigidity of the apparatus, iron, aluminum, bronze or the like is used as the material for the main-body stay 2. In order to reduce the weight of the apparatus, the main-body stay 2 has the structure of a hollow channel. The image forming apparatus of this embodiment utilizes the hollow main-body stay 2 as an exhaust duct. A third absorber 51*c* is laid on the entire inner base of the main-body stay 2, and air filters 4R and 4L are provided at openings at both ends of the main-body stay 2. The material for the air filters 4R and 4L is porous as in the case of the absorbers, but is coarse in order to prevent the generation of pressure loss.

The above-described exhaust joint 53 is connected to a portion of the upper surface of the main-body stay 2. Air containing ink mist which has been discharged from the exhaust joint 53 but has not been absorbed by the second absorber 51*b* is first projected onto the third absorber 51*c* on the inner base of the main-body stay 2. The air containing the ink mist which has not been completely absorbed by the third absorber 51*c* flows within the main-body stay 2, and is discharged via the air filters 4R and 4L.

The main-body stay 2 is disposed in the main scanning direction A corresponding to the longitudinal direction of the apparatus. Since the openings of the main-body stay 2 are at both ends of the main-body stay 2, an exhaust channel which is long in the horizontal direction is provided. Accordingly, this embodiment has the effect that while the air moves through this exhaust channel, ink mist which could not be completely removed by a plurality of mist removing means drops and is absorbed. Since the exhaust channel is longer as the size of the apparatus is larger, the effect of removal of ink mist is improved.

Since the openings at both ends of the main-body stay 2 are present within the main body of the image forming apparatus, exhaust air exhausted via the air filters 4R and 4L circulates within the main body of the image forming apparatus.

Although in this embodiment, the image forming apparatus in which recording is performed on the recording material Pr having the shape of a roll has been illustrated, the present invention is not limited to such a configuration. Any other image forming apparatus having a recording-material conveying path such that the recording material Pr does not interfere with the exhaust unit 71 may also be used.

As described above, according to the embodiment, since the suction ports 45*a* of the suction nozzles 45 are provided at uppermost portions, and the exhaust ports 45*b* of the suction nozzles 45, and the exhaust unit 71 are disposed at portions lower than the suction ports 45*a*, it is possible to provide an image forming apparatus which can prevent leakage of ink collected and accumulated within each space (duct) into the apparatus.

In addition, according to the embodiment, since the suction ports 45*a* suck air containing ink mist at portions near the image forming region 72, it is possible to provide an image forming apparatus which can minimize diffusion of ink mist within the apparatus.

Furthermore, according to the embodiment, since the first absorber 51*a* and the second absorber 51*b* are provided on the slopes within he suction duct 50 and the exhaust joint 53, respectively, it is possible to provide an image forming apparatus which can improve the effect of collecting and removing ink mist while preventing the pressure loss of the air flow and degradation of the suction efficiency of the suction fan 52.

According to the above-described embodiment, since air passing through the exhaust unit 71 is circulated within the apparatus via the first absorber 51*a*, the second absorber 51*b*, the third absorber 51*c*, the air filters 4R and 4L, and a plurality of mist collection means, the air does not stain walls and the like present near a location where the image forming apparatus is installed.

According to the above-described embodiment, since the inside of the main-body stay 2 is utilized as a duct, it is possible to provide a light and inexpensive image forming apparatus in which it is unnecessary to provide a duct dedicated for exhaust.

The individual components shown in outline in the drawings are all well known in the image forming apparatus arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus for forming an image in a predetermined image forming region by discharging ink droplets, said apparatus comprising:

an image forming unit for forming an image in the predetermined image forming region; and a suction unit for sucking air including ink mist generated when forming the image by said image forming unit, said suction unit including:

at least one suction port provided near the predetermined image forming region; and an exhaust path formed below said suction port, said exhaust path including:

an exhaust port for exhausting air including ink mist sucked from said suction port in a predetermined direction;

a slope provided at a crossing point of the exhausted air exhausted from said exhaust port and inclined in a direction of flow of the exhausted air; and an ink collecting portion provided on said slope.

2. An apparatus according to claim 1, wherein said ink collecting portion comprises an ink absorbing member.

3. An apparatus according to claim 2, wherein a part of said exhaust path comprises a hollow stay member for improving a rigidity of said image forming apparatus.

4. An apparatus according to claim 3, wherein a filter is provided in an opening at each end of said stay member.

5. An apparatus according to claim 3, wherein an ink absorber is provided on a base inside of a hollow of said stay member.

6. An apparatus according to claim 5, wherein an opening of said stay member is positioned within said image forming apparatus.

7. An apparatus according to claim 3, wherein an opening of said stay member is positioned within said image forming apparatus.

8. An apparatus according to claim 1, wherein a part of said exhaust path comprises a hollow stay member for improving a rigidity of said image forming apparatus.

9. An apparatus according to claim 8, wherein a filter is provided in an opening at each end of said stay member.

10. An apparatus according to claim 8, wherein an ink absorber is provided on a base inside of a hollow of said stay member.

11. An apparatus according to claim 8, wherein an opening of said stay member is positioned within said image forming apparatus.

12. An apparatus according to claim 1, wherein said image forming unit comprises electrothermal transducers for generating energy for discharging ink droplets.

13. An image forming apparatus according to claim 1, wherein the inclination of said slope makes its height lower as going from upstream to downstream of flow of the air in said exhaust path.

14. An image forming apparatus according to claim 1, wherein said slope is provided below said exhaust port.

15. An image forming apparatus according to claim 1, wherein said suction port is positioned upstream relative to said image forming region in a conveyance direction of recording medium.

16. An image forming apparatus according to claim 1, wherein said image forming unit performs recording on a recording medium drawn from a recording medium holding unit which holds a rolled recording medium.

17. A suction apparatus for sucking air, which includes ink mist generated by formation of an image, near an image forming region of an image forming apparatus, said suction apparatus comprising:

at least one suction port provided near the image forming region; and an exhaust path including an exhaust port for exhausting air including ink mist sucked from said suction port in a predetermined direction, a slope provided at a crossing point of air exhausted from said exhaust port and inclined in a direction of flow of the air exhausted from said exhaust port, and an ink absorbing member provided on said slope.

18. A suction apparatus according to claim 17, wherein said ink absorbing unit comprises an ink absorbing member.

19. A suction apparatus according to claim 18, wherein a part of said exhaust path comprises a hollow stay member for improving a rigidity of said image forming apparatus.

20. A suction apparatus according to claim 19, wherein a filter is provided in an opening at each end of said hollow stay member.

21. A suction apparatus according to claim 19, wherein an ink absorber is provided on a base inside of said hollow stay member.

22. A suction apparatus according to claim 19, wherein an opening of said hollow stay member is positioned within said image forming apparatus.

23. A suction apparatus according to claim 17, wherein a part of said exhaust path comprises a hollow stay member for improving a rigidity of said image forming apparatus.

24. A suction apparatus according to claim 23, wherein a filter is provided in an opening at each end of said hollow stay member.

25. A suction apparatus according to claim 23, wherein an ink absorber is provided on a base inside of said hollow stay member.

26. A suction apparatus according to claim 23, wherein an opening of said hollow stay member is positioned within said image forming apparatus.

27. An image forming apparatus for forming an image in a predetermined image forming region by discharging ink droplets, said apparatus comprising:

an image forming unit for forming an image in a predetermined image forming region;

at least one suction port provided near said image forming region in order to suck air including ink mist generated in said image forming unit when forming the image; and an exhaust path formed below said suction port, said exhaust path comprising:

a suction duct into which air including ink mist sucked from said suction port is flown;

an exhaust port for exhausting the air sucked from said suction port in a predetermined direction;

a first slope formed in said suction duct, provided at a crossing point of the air exhausted from said exhaust port, and inclined in a direction of flow of the exhausted air;

a first ink collecting unit provided on said first slope;

a fan connected to said suction duct in order to suck said air including ink mist from said suction port and to exhaust it through said suction duct;

a second slope provided at the crossing point of the air exhaustesd from the exhaust port of said fan and inclined in a direction of flow of the air exhausted from said fan; and a second ink collecting unit provided on said second slope.

28. An image forming apparatus according to claim 27, wherein the inclination of said first slope makes its height lower as going from upstream to downstream of flow of air in said suction duct.

29. An image forming apparatus according to claim 27, wherein said first slope is provided below said exhaust port.

30. An image forming apparatus according to claim 27, wherein the inclination of said second slope makes its height lower as far from the suction port of said fan.

31. An image forming apparatus according to claim 27, wherein said suction port is positioned upstream relative to said image forming region in a conveyance direction of recording medium.

32. An image forming apparatus according to claim 27, wherein said image forming unit performs recording on the recording medium drawn from a recording medium holding unit which holds a rolled recording medium.

* * * * *

UNITED STATES PATENT AND TRADEMARK OFFICE

CERTIFICATE OF CORRECTION

PATENT NO. : 6,712,448 B2
DATED : March 30, 2004
INVENTOR(S) : Tsurui

It is certified that error appears in the above-identified patent and that said Letters Patent is hereby corrected as shown below:

Column 4,
Line 56, "inclination a" should read -- inclination α --.

Signed and Sealed this

Thirtieth Day of November, 2004

JON W. DUDAS
*Director of the United States Patent and Trademark Office*